US008088458B2

(12) United States Patent
Watanabe et al.

(10) Patent No.: US 8,088,458 B2
(45) **Date of Patent: *Jan. 3, 2012**

(54) MAGNETIC LATENT IMAGE HOLDING BODY, PROCESS CARTRIDGE, AND IMAGE FORMING APPARATUS

(75) Inventors: Yasuaki Watanabe, Kanagawa (JP); Ryosaku Igarashi, Kanagawa (JP); Keitaro Mori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 793 days.

This patent is subject to a terminal disclaimer.

(21) Appl. No.: 12/061,845

(22) Filed: Apr. 3, 2008

(65) Prior Publication Data

US 2009/0017232 A1 Jan. 15, 2009

(30) Foreign Application Priority Data

Jul. 13, 2007 (JP) ..... 2007-184268

(51) Int. Cl.
*B44F 1/10* (2006.01)

(52) U.S. Cl. ..... 428/29; 428/812; 428/832; 428/836; 428/842; 428/846; 428/195.1; 428/206; 428/323; 428/500

(58) Field of Classification Search ..... 428/29, 428/812, 832, 836, 842, 846, 195.1, 206, 428/323, 500

See application file for complete search history.

(56) References Cited

U.S. PATENT DOCUMENTS 5,217,836 A * 6/1993 Takiguchi et al. ..... 430/109.3
7,867,684 B2 * 1/2011 Watanabe et al. ..... 430/115

FOREIGN PATENT DOCUMENTS

| | | |
|---|---|---|
| JP | 05-188827 | 6/1993 |
| JP | 05-87834 | 12/1993 |
| JP | 06-004008 | 1/1994 |
| JP | 09-156150 | 6/1997 |

* cited by examiner

*Primary Examiner* — Betelhem Shewareged
(74) *Attorney, Agent, or Firm* — Fildes & Outland, P.C.

(57) ABSTRACT

The present invention provides a magnetic latent image holding body in which the surface thereof has water repellency and a magnetic latent image is visualized by a liquid developer that contains a magnetic toner and an aqueous medium.

17 Claims, 2 Drawing Sheets

MAGNETIC LATENT IMAGE HOLDING BODY, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-184268 filed Jul. 13, 2007.

BACKGROUND

1. Field of the Invention

The present invention relates to a magnetic latent image holding body, a process cartridge, and an image forming apparatus.

2. Related Art

A magnetic printing apparatus that allows printing of a required number of copies in a single operation of forming a latent image is known. In this magnetic printing apparatus, a magnetic latent image that is magnetically formed is held on a magnetic recording medium (a magnetic latent image holding body), and in a development region, a magnetic toner is supplied to the magnetic recording medium so that the magnetic latent image is visualized as a toner image. Further, in a transfer region, a recording medium such as a paper sheet is pushed on the magnetic recording medium so that the visualized toner image is transferred to the recording medium, and the transferred recording medium is conveyed to a fixing region and subjected to fixing processing, thereby bringing image printing to completion. This system is typically called magnetography.

In the aforementioned system, the magnetized state of the magnetic recording medium is maintained semi-permanently. Therefore, if a latent image is formed once, a large number of copies can be obtained just by carrying out a development/transfer process repeatedly. Further, in order to obtain multiple copies, the latent image does not need to be recorded again, thereby making the system adaptable to high-speed operation. Moreover, magnetism is stable with respect to the environment unlike static electricity, and a high-resolution image can also be obtained.

SUMMARY

According to an aspect of the invention, there is provided a magnetic latent image holding body in which the surface thereof has water repellency and a magnetic latent image is visualized by a liquid developer that contains a magnetic toner and an aqueous medium.

DETAILED DESCRIPTION

Figure 1:
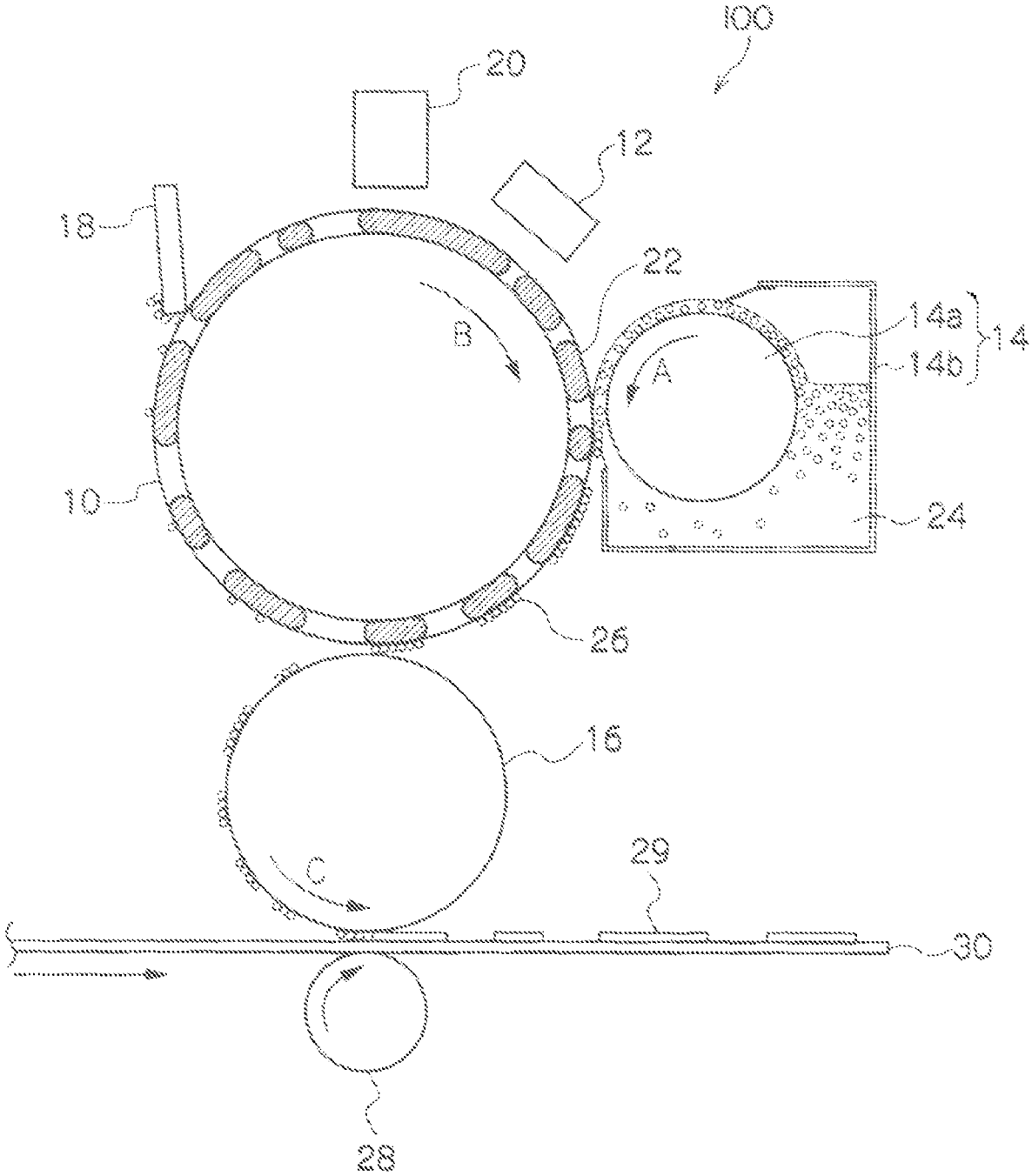
FIG. 1 is a structural diagram that schematically shows an example of an image forming apparatus according to an exemplary embodiment of the present invention.

The present invention will be hereinafter described in detail by way of embodiments. Note that a magnetic latent image holding body and a process cartridge of the present invention will be described in conjunction with an embodiment of an image forming apparatus mentioned below.

The image forming apparatus according to an exemplary embodiment of the present invention includes: a magnetic latent image holding body (occasionally referred to as an "image holding body") having water repellency on the surface thereof; a magnetic latent image forming unit that forms a magnetic latent image on the magnetic latent image holding body; a developer storage unit that stores therein a liquid developer containing a magnetic toner and an aqueous medium; a developer supplying unit that supplies the liquid developer to the magnetic latent image holding body with a magnetic latent image formed thereon so as to visualize the magnetic latent image as a toner image; a transfer unit that transfers the toner image to a recording medium; and a degaussing unit that demagnetizes the magnetic latent image on the magnetic latent image holding body.

In the exemplary embodiment of the present invention, as a developer used for magnetic development, a liquid developer in which a magnetic toner is dispersed in an aqueous medium is used. The aqueous medium mentioned herein means a solvent that contains at least 50 mass % of water. Further, "water" refers to purified water such as distilled water, ion exchange water, or ultra-pure water.

In so-called liquid magnetography using a liquid developer, usually, a toner image on the image holding body immediately after having been developed contains a large amount of excess developer. Hence, there are cases in which a drying process should be provided prior to transfer of the toner image to a recording medium such as a paper sheet, so as to remove an excess developer.

In the exemplary embodiment of the present invention, due to the aqueous medium being used as a dispersion medium in the liquid developer, water has a large surface tension by means of hydrogen bond. For this reason, when the liquid developer is used in combination with an image holding body having water repellency described below, even if the liquid developer comes into contact with the image holding body during development, the liquid that is the dispersion medium is not easily transferred to the image holding body, and the toner image can be transferred to the recording medium in the state in which no liquid remain on the image holding body.

Furthermore, there is almost no possibility that during development, the aqueous medium having a large surface tension would moisten and spread on the surface of the image holding body. The magnetic toner having a high degree of mobility and homogeneously dispersed in the developer is transferred only to the magnetic latent image using magnetic force thereof at the same time as that it comes into contact with the image holding body. Therefore, a development environment in which almost no image fog occurs is created.

Note that in the description set forth herein, the term "homogeneous" that concerns dispersion and the like, as above, refers to no presence of an agglomerate that is sized so as to an agglomerate of at least a dozen of primary particles such as magnetic powder or polymer particles in the system. The same applies to the rest.

The image forming process applied to the exemplary embodiment of the present invention is a process in which a toner image is formed by forming a magnetic latent image on an image holding body, without using an electrostatic latent image. That is, the aforementioned process is neither a so-called electrophotographic process, a process of forming an electrostatic latent image on dielectric material using an ion (ionography), nor a process of forming an electrostatic latent image on a charged dielectric material by means of heat of a thermal head in accordance with image information. The structure of the image forming process is not particularly limited except that a liquid developer containing an aqueous medium is used as a developer, and an image holding body having water repellency is used as an image holding body.

An image forming apparatus based on a magnetic development process using a liquid developer in the exemplary embodiment of the present invention will be briefly described hereinafter. Note that particulars about constituent materials of the liquid developer to be used, and the like will be described later.

FIG. 1 is a structural diagram that schematically shows an example of the image forming apparatus of the exemplary embodiment of the present invention. The image forming apparatus 100 includes a magnetic drum (a magnetic latent image holding body) 10, a magnetic head (a magnetic latent image forming unit) 12, a developing device (a developer storage unit and a developer supplying unit) 14, an intermediate transfer body (a transfer unit) 16, a cleaner 18, a degaussing device (a degaussing unit) 20, and a transfer/fixing roller (a transfer unit) 28. The magnetic drum 10 has a cylindrical configuration. The magnetic head 12, the developing device 14, the intermediate transfer body 16, the cleaner 18 and the degaussing device 20 are arranged in the outer peripheral region of the magnetic drum 10 in the order named.

The operation of the image forming apparatus 100 will be briefly described hereinafter.

First, the magnetic head 12 is connected to, for example, information equipment (not shown), and receives binarized image data transmitted from the information equipment. The magnetic head 12 is used to form a magnetic latent image 22 on the magnetic drum 10 by emitting magnetic lines of force while scanning on the side surface of the magnetic drum 10. In FIG. 1, the magnetic latent image 22 is indicated by a shaded portion in the magnetic drum 10.

The developing device 14 includes a developing roller (a developer supplying unit) 14*a* and a developer storage container (a developer storage unit) 14*b*. The developing roller 14*a* is provided such that a part thereof is immersed in a liquid developer 24 stored in the developer storage container 14*b*.

The liquid developer 24 contains an aqueous medium and toner particles. The toner particles are a magnetic toner that contains magnetic material. The aqueous medium and the toner particles will be described below in detail.

The toner particles are homogeneously dispersed in the liquid developer 24. For example, due to the liquid developer 24 being continuously agitated at a predetermined rotational speed by a stirring member provided in the developer storage container 14*b*, positional fluctuation of the density of toner particles in the liquid developer 24 is reduced. As a result, the liquid developer 24 having toner particles of which density fluctuation is alleviated is supplied to the developing roller 14*a* that rotates in the direction indicated by arrow A in FIG. 1.

The liquid developer 24 supplied to the developing roller 14*a* is conveyed to the magnetic drum 10 in the state that the amount thereof supplied is limited to a certain value by a regulating member described below, and is supplied to the magnetic latent image 22 at a position in which the developing roller 14*a* and the magnetic drum 10 are disposed in proximity to each other (or come into contact with each other). As a result, the magnetic latent image 22 is visualized and forms a toner image 26.

The developed toner image 26 is conveyed by the magnetic drum 10 that rotates in the direction indicated by arrow B in FIG. 1, and is transferred to a paper sheet (a recording medium) 30. In the exemplary embodiment of the present invention, however, prior to the image being transferred to the paper sheet 30, the toner image is once transferred to the intermediate transfer body 16 for the purposes of improving transfer efficiency for the recording medium inclusive of peeling efficiency of a toner image from the magnetic drum 10 and further performing transfer and fixing on the recording medium at the same time.

The transfer of an image to the intermediate transfer body 16 is suitably performed by shearing transfer (non-electric-field transfer) because the toner particles have almost no charge. Specifically, the magnetic drum 10 that rotates in the direction indicated by arrow B, and the intermediate transfer body 16 that rotates in the direction indicated by arrow C are made into contact with each other with a certain nip therebetween (a contact surface having a contact width along the moving direction), and the toner image 26 is moved on the intermediate transfer body by means of adsorptive force for the toner image 26, which force is larger than the magnetic force of the magnetic drum 10. At this time, the difference in the peripheral velocity between the magnetic drum 10 and the intermediate transfer body 16 may be provided.

Subsequently, the toner image conveyed by the intermediate transfer body 16 in the direction indicated by arrow C is transferred to the paper sheet 30 at the position in which the image comes into contact with the transfer/fixing roller 28, and is simultaneously fixed thereon.

The transfer/fixing roller 28 nips the paper sheet 30 together with the intermediate transfer body 16, and causes the toner image on the intermediate transfer element 16 to adhere to the paper sheet 30. As a result, the toner image is transferred to the paper sheet 30, and at the same time, the toner image can be fixed on the paper sheet. Fixing of the toner image can be performed only by application of pressure depending on the characteristic of the toner, or can also be performed by application of pressure and heat using a heating element provided in the transfer/fixing roller 28.

In the magnetic drum 10 after the toner image 26 is transferred to the intermediate transfer body 16, a residual transfer toner is conveyed to a position in which the magnetic drum comes into contact with the cleaner 18, and is recovered by the cleaner 18. After cleaning, the magnetic drum 10 rotates and moves to a degaussing position in the state of holding the magnetic latent image 22.

The degaussing device 20 erases the magnetic latent image 22 formed on the magnetic drum 10. The magnetic drum 10 is returned by the cleaner 18 and the degaussing device 20 to the state that the magnetic layer thereof is uniformly magnetized before an image is formed. Due to the aforementioned operation being performed repeatedly, images sequentially transferred from the information equipment are continuously formed in a short time. Incidentally, the magnetic head 12, the developing device 14, the intermediate transfer body 16, the transfer/fixing roller 28, the cleaner 18 and the degaussing device 20 provided in the image forming apparatus 100 are all made to operate in synchronous with the rotational speed of the magnetic drum 10.

Next, the structural parts of the image forming apparatus according to the exemplary embodiment of the present invention will be described in a sequential manner.

(Magnetic Latent Image Holding Body)

The magnetic drum (magnetic latent image holding body) 10 is structured in such a manner that a base layer such as Ni, Ni—P or the like having the thickness of about 1 μm to 30 μm is formed on a drum made from metal such as aluminum, and a magnetic recording layer of Co—Ni, Co—P, Co—Ni—P, Co—Zn—P, Co—Ni—Zn—P or the like having the thickness of approximately 0.1 μm to 10 μm is formed on the base layer, and further, a protective layer of Ni, Ni—P or the like having the thickness of approximately 0.1 μm to 5 μm is formed on the magnetic recording layer. If a defect such as a pin hole exists on metal plating of the base layer, a defect is also caused in the magnetic recording layer. Hence, fine and even plating is suitably carried out. In stead of plating, sputtering, vapor deposition or the like may be used. Further, the base layer and the protective layer may be desirably non-magnetic. It is suitable that the surfaces of these layers has surface accuracy maintained by tape polishing for the purpose of precisely maintaining a clearance between the magnetic drum and the magnetic head 12 that forms a magnetic latent image.

The film thickness of the magnetic recording layer is preferably in a range from 0.1 μm to 10 μm, and the magnetic characteristics of the magnetic recording layer are suitably set such that coercive force is in a range from approximately 16000 A/m to 80000 A/m (200 oersted to 1000 oersted (Oe)), and residual magnetic flux density is in a range from approximately 100 mT to 200 mT (1000 gauss to 2000 gauss (G)).

The aforementioned structure of the magnetic drum 10 is shown in the case of horizontal magnetic recording type, but in the case of vertical magnetic recording type, a recording layer of Co—Ni—P or the like may be provided on a non-magnetic layer or a soft magnetic layer having high magnetic permeability may be provided below the recording layer. The invention is not limited to either of them. Further, the magnetic latent image holding body is not limited to the drum configuration as in the present embodiment, and may also be formed in the shape of a belt.

In the exemplary embodiment of the present invention, the magnetic drum 10 having water repellency is used. The term "water repellency" mentioned herein means the property of repelling water, and specifically means that the contact angle between the surface of the magnetic drum and pure water is at least 70 degrees.

Further, the contact angle between the magnetic drum 10 and pure water in the exemplary embodiment of the invention is preferably about 70 degrees or more, and more preferably about 100 degrees or more. If the contact angle is less than about 70 degrees, there are cases in which even if development is carried out by the liquid developer using an aqueous medium described below, the liquid may remain on the magnetic drum after development or image fog may occur.

The contact angle on the surface of the magnetic drum 10 is obtained by using a contact angle meter (manufactured by Kyowa Interface Science Co., Ltd., trade name: CA-X) under the environment with a temperature of 25° C. and a humidity of 50% RH in such a manner that pure water is dropped on the surface of the magnetic drum in the amount of 3.1 μl and the time elapsed thereafter is set at 15 seconds. Incidentally, the contact angles are measured at four spots at the end portion and the central portion in the circumferential direction of the magnetic drum, and an average value of these measured values is determined as the contact angle.

In order that the surface of the magnetic drum 10 is formed into a surface having the aforementioned suitable contact angle, the surface of the magnetic drum having the aforementioned structure may be subjected to surface coating.

Examples of the surface coating include fluorine lubricating plating, coating using a polymer that contains a fluorine atom or a silicon atom, and the like. The fluorine lubricating plating is a functional plating that a fluorine resin (polytetrafluoroethylene: PTFE) is conjugated and eutectoid with nonelectrolytic nickel plating. The formed film includes PTFE particles homogeneously deposited, and thus, has a combination of the characteristics of the nonelectrolytic nickel plating and the PTFE resin.

Further, examples of the coating using a polymer that contains a fluorine atom or a silicon atom include coating on the surface of the protective layer with, for example, a polymer having a fluorine-containing cyclic structure, a copolymer of fluoro-olefin and vinyl ether, a photopolymerization type fluorine resin composition or the like, sputtering of a fluorine-containing polymer on the surface of the protective layer, whereby the entire surface may be covered.

Among these examples of surface coating, fluorine lubricating plating is suitably used from the viewpoint of adhesiveness with an underlying plating layer, durability of the coating, and the like. The aforementioned fluorine lubricating plating or fluorine resin coating may be applied on the formed protective layer, or the layer formed by fluorine lubricating plating or the like may also be used as the protective layer.

The film thickness of the surface layer formed by the surface coating is preferably 0.1 μm to 5 μm, and more preferably 0.3 μm to 3 μm.

(Magnetic Latent Image Forming Unit)

The magnetic latent image forming device (magnetic latent image forming unit) is basically comprised of a magnetic head 12 and a drive circuit thereof. The magnetic head 12 is mainly classified into a full-line type magnetic head and multi-channel type magnetic head. In the case of the full-line type magnetic head, it is not necessary to scan the magnetic head 12, but in the case of the multi-channel type magnetic head, it is necessary for the magnetic head 12 to scan the magnetic drum 10. A scan method includes a serial scan and a helical scan. In the helical scan, as long as the rotational speed of the magnetic drum 10 is changed particularly only in the latent image forming process, the recording speed can be increased.

On the other hand, in the case of the full-line type magnetic head, for example, if the resolution thereof is set at 600 dpi, a head including approximately 500 channels is required so as to cover the recording width in the transverse direction of an A4-size paper sheet. Only if these channels are arranged to form a full line configuration, scanning of the head becomes unnecessary, thereby allowing extremely high-speed recording. Further, in order to form the above full line configuration, overlapping of head cores becomes necessary. However, as the resolution becomes higher, the track pitch becomes smaller. Therefore, a coil to be inserted in the head core needs to be made thin as far as possible, and for example, a flat sheet coil is used.

Due to a coil of each channels in the magnetic head 12 being electrified, magnetic leakage flux is generated from the end of a magnetic pole, and thus, the magnetic recording medium is magnetized to form a magnetic latent image. Output from the magnetic head 12 is required two to three times the coercive force of the magnetic recording layer in the magnetic drum 10. There is no possibility that the formed magnetic latent image might not vanish unless it is erased by the degaussing device 20, and a multiple copy function is provided as long as respective processes of development, transfer, fixing and cleaning are performed repeatedly. Further, the magnetic latent image is not easily affected by humidity, and therefore, it is excellent in the environmental stability compared with an electrostatic system.

(Developer Storage Unit, Developer Supplying Unit)

Figure 2:
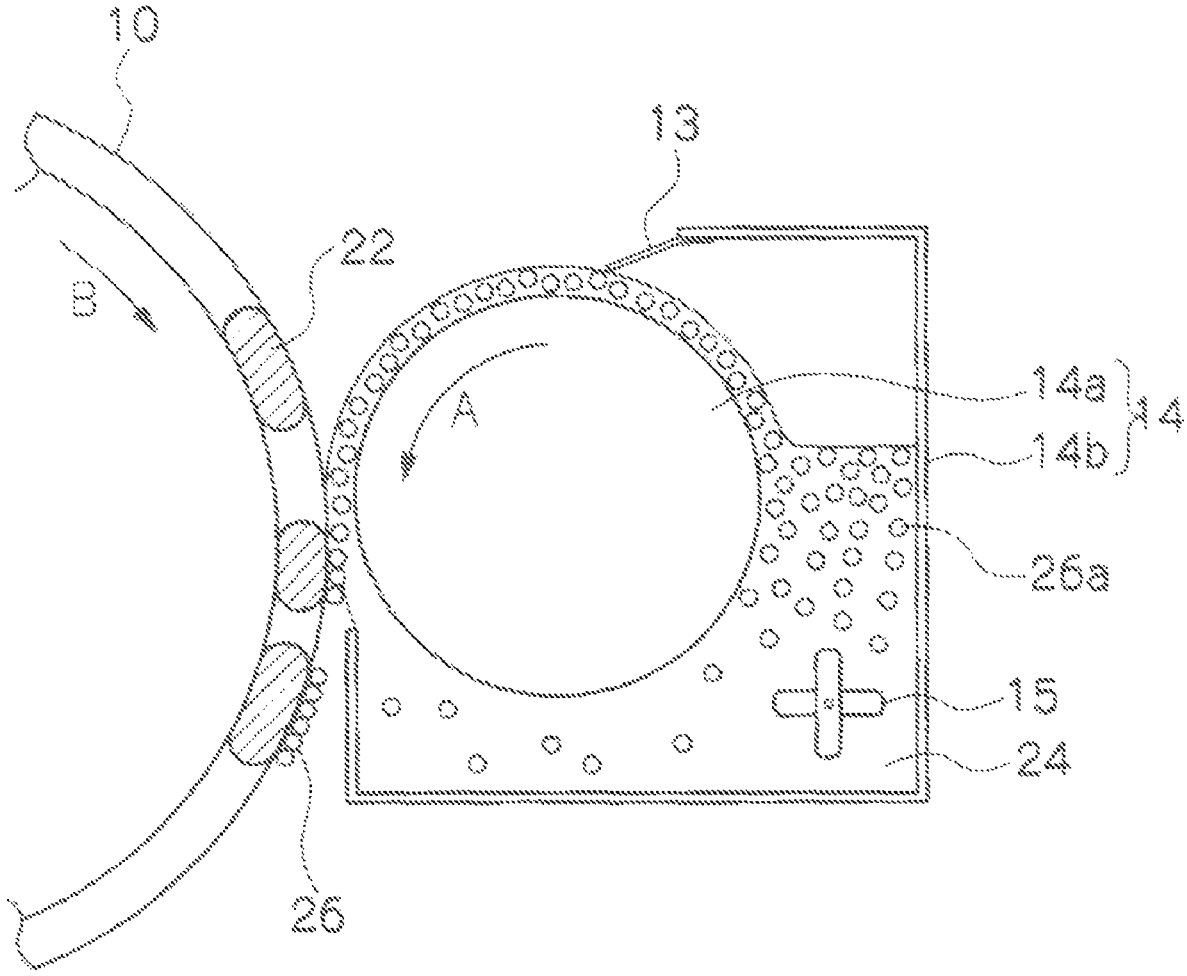
FIG. 2 is a schematic enlarged diagram showing a development region in an example of the image forming apparatus according to an exemplary embodiment of the present invention.

FIG. 2 is a schematic diagram showing the development region in FIG. 1 being enlarged.

The developing device (developer storage unit and developer supplying unit) 14 is equipped with a developer storage container 14*b*, and a developing roller 14*a* that supplies the liquid developer 24 stored in the developer storage container 14*b* to the magnetic drum 10 in a toner supplying region (occasionally hereinafter referred to as a "supplying region"). As shown in FIG. 2, the developing roller 14*a* holds a layered liquid developer 24 on the peripheral surface thereof, and is disposed at a position apart from the magnetic drum 10 (for example, the magnetic drum and the developing device form a process cartridge). Further, the regulating member 13 is disposed at the upstream side of the supplying region and maintains the layer thickness of the liquid developer 24 to a predetermined thickness. The regulating member 13 is a plate-shaped member that extends entirely over the width of the developing roller 14*a* along the axial direction of the roller, and one edge of the regulating member 13 is disposed apart from the peripheral surface of the developing roller 14*a* by a predetermined distance corresponding to a desired layer thickness of toner.

In the developing device 14, the liquid developer 24 that contains toner particles 26*a* and an aqueous medium is stored in the developer storage container 14*b*. The liquid developer 24 is continuously agitated by a stirring member 15 provided in the developer storage container 14*b* at a predetermined rotational speed, and thus, a positional variation of density of the toner particles 26*a* in the liquid developer 24 is reduced. Accordingly, the liquid developer 24 containing toner particles 26*a* whose particle density has a reduced fluctuation is supplied to the developing roller 14*a*.

Although not shown in FIG. 2, a supplying roller may be provided which rotates in contact with or in proximity with the developing roller 14*a* so as to supply the liquid developer to the developing roller 14*a*.

The developing roller 14*a* is provided with plural magnetic poles including south poles and north poles along the circumferential direction thereof, and these magnetic poles are fixed so as not to rotate together with the developing roller 14*a*. One of these magnetic poles is particularly disposed between the regulating member 13 and the supplying region. Accordingly, the liquid developer 24 that contains a magnetic toner held by the developing roller 14*a* is held by magnetic force lines of these magnetic poles (a development magnetic field) and is conveyed toward the magnetic drum 10.

Note that the developing roller 14*a* does not need to be a magnetic roller as long as the roller surface itself has conveying force of the liquid developer, and for example, an anilox roller, a sponge roller or the like can also be used.

The regulating member 13 is provided at a position after the developing roller 14*a* holds the liquid developer 24 in the developer storage container 14*b* until the developer is supplied to the magnetic drum 10. The amount of the liquid developer 24 to be supplied to the magnet latent image 22 is determined based on a clearance formed by the regulating member 13 and the developing roller 14*a*. The material of the regulating member 13 is suitably rubber, phosphor bronze or the like. The liquid developer 24 that is limited to a fixed amount of supply by the regulating member 13 is conveyed to the magnetic drum 10, and is supplied to the magnetic latent image 22. As a result, the magnetic latent image 22 is visualized to form a toner image 26.

Further, in the development described above, the toner particles are magnetic toner, and therefore, development can be performed even though no magnetic field is applied to the developing roller 14*a*. In order to perform more efficient development, the magnetic field may be applied to the developing roller 14*a*.

(Transfer Unit, Fixing Unit)

The toner image visualized in the developing device 14 is transferred to the paper sheet 30 by the transfer unit. As described above, in the exemplary embodiment of the present invention, the toner image is not directly transferred to the paper sheet from the magnetic drum 10, and a system is used in which, after the toner image is once transferred to the intermediate transfer body 16, it is transferred to and fixed on the paper sheet 30. First, a description will be given below of the transfer of the toner image to the intermediate transfer body 16.

The intermediate transfer body 16 comes into contact with the magnetic drum 10 to cause the toner image to be transferred thereto. Examples of the transfer system generally include an electrostatic transfer system, a pressure transfer system, and an electrostatic pressure system using both of the aforementioned systems. However, in the present embodiment, as described above, the toner particles have no charge, and therefore, the electrostatic transfer system or the electrostatic pressure system cannot be used. On the other hand, the pressure transfer system is a system in which, usually due to a pressure between the magnetic drum 10 and the transfer medium, the toner image is fixed and transferred to the surface of the transfer medium while being subjected to plastic deformation, and this system can be used together with shearing transfer.

In the exemplary embodiment of the present invention, as described above, the toner image 26 on the magnetic drum 10 is moved to the intermediate transfer body due to adsorptive force larger than the magnetic force of the magnetic drum 10, and therefore, it is suitable that adhesive transfer is carried out in the state in which the intermediate transfer body 16 has an adhesive property. Accordingly, for example, a silicone rubber layer having a low degree of hardness may be formed on the surface of the intermediate transfer body 16.

Subsequently, the toner image 26 transferred to the intermediate transfer body 16 is then transferred to the paper sheet.

The transfer/fixing roller 28 is disposed at the opposite side of the intermediate transfer body 16 with respect to the magnetic drum 10, so as to form a nip between the intermediate transfer body 16 and the transfer/fixing roller 28. The paper sheet 30 is fed into the nip between the intermediate transfer body 16 and the transfer/fixing roller 28 in timing with the toner image 26 on the intermediate transfer body 16. The transfer/fixing roller 28 is formed by, for example, a stainless steel base body, a silicone rubber layer, or a fluorine-containing rubber layer. Due to the paper sheet 30 passing through the nip being pressed on the intermediate transfer body 16, a toner image on the intermediate transfer body 16 is transferred to the paper sheet 30.

In the exemplary embodiment of the present invention, the toner image 26 is transferred from the intermediate transfer body 16 to the paper sheet 30, and at the same time, the toner image 26 is fixed on the paper sheet 30. Specifically, as long as the intermediate transfer body 16 is formed in the shape of a roller as shown in FIG. 1, the intermediate transfer body forms a roller pair together with the transfer/fixing roller 28. Therefore, the intermediate transfer body 16 and the transfer/fixing roller 28 respectively have structures of a fixing roller and a pressing roller in a fixing device, thereby making it possible to demonstrate a fixing function. That is to say, when the paper sheet 30 passes through the nip, a toner image is transferred, and at the same time, the paper sheet is pressed by the transfer/fixing roller 28 against the intermediate transfer body 16, whereby toner particles that form the toner image are softened and infiltrated into fiber of the paper sheet 30.

In the aforementioned case as well, the toner image can be fixed on the paper sheet 30 depending on the toner particles to be used. If the toner image is not sufficiently fixed, the toner image is fused by means of heating by the transfer/fixing roller 28 or the like, and infiltrated into fiber of the paper sheet 30, and then fixed. As a result, a fixed image 29 is formed. In this state, even if the paper sheet 30 is bent, or an adhesive tape is applied to the image and thereafter stripped, the fixed image 29 may not be peeled away.

In the exemplary embodiment of the present invention, transfer of an image to the paper sheet 30 and fixing of the image thereon are performed at the same time. However, the transfer process and fixing process may be separated from each other, and fixing process may be performed after the transfer process. In this case, the transfer roller that transfers a toner image from the magnetic drum 10 has the function according to the intermediate transfer body 16.

(Cleaner)

In the case in which the transfer efficiency of a toner image from the magnetic drum 10 to the intermediate transfer body 16 does not become 100%, a part of the toner image 26 would remain on the magnetic drum 10 after transfer of the toner image. A cleaner 18 is used to remove the residual portion of the toner image. Basically, the cleaner 18 is formed by a cleaning blade made from rubber or the like, and a container of remaining magnetic toner.

On the contrary, in the case in which the transfer efficiency approximates 100% and the residual toner is insignificant, it is not necessary to provide the cleaner 18.

(Degaussing Unit)

In the case in which a new image is formed again, the formed magnetic latent image needs to be erased before a magnetic latent image is formed by the magnetic head 12. The degaussing device 20 includes a permanent magnet system and an electromagnet system. In use of the permanent magnet system, the magnetic drum 10 is magnetized in the circumferential direction thereof so as to prevent occurrence of local leakage of a magnetic flux, and thus, energy such as electric power is not required and is inexpensive. However, in the case in which the magnetic latent image is not erased, it is necessary for the degaussing device 20 to be moved with respect to the magnetic drum 10 to increase a magnetic distance, thus making the magnetic field to be demagnetized weak. On the contrary, the electromagnet system is made of a yoke and a coil, and these members need to be electrified. However, in the case in which the magnetic latent image does not need to be erased, the magnetic field to be demagnetized becomes zero by preventing passing of electric current, thereby resulting in relatively free control.

In the exemplary embodiment of the present invention, the aforementioned permanent magnet system and temporary electromagnet system both can be used.

(Liquid Developer)

Next, a description will be given of a liquid developer used in the image forming apparatus 100 having the structure described above.

The liquid developer used in the exemplary embodiment is prepared in such a manner that a magnetic toner is dispersed in an aqueous medium. Further, as the aforementioned magnetic toner, magnetic polymer particles containing magnetic powder in a polymer compound is generally used. The magnetic polymer particles mentioned herein means those formed by magnetic powder dispersion particles with magnetic powder being dispersed in the polymer.

—Polymer Compound—

As the polymer compound described above, a resin that has been conventionally used in a magnetic recording device can be used. Specific examples thereof include: homopolymers of styrene and a substitution product of styrene, and copolymer resin thereof; a copolymer resin of styrene and (meth)acrylic acid ester; a multi-copolymer resin of styrene, (meth)acrylic acid ester and other vinyl-based monomer; a styrene-based copolymer resin of styrene and other vinyl-based monomer; and material obtained by cross-linking of each of the resins described above. Further examples thereof include polymethyl methacrylate, polybutyl methacrylate, polyvinyl acetate resin, polyester resin, epoxy resin, polyamide resin, polyolefin resin, silicone resin, polybutyral resin, polyvinyl alcohol resin, polyacrylate resin, phenol resin, aliphatic or alicyclic hydrocarbon resin, petroleum resin, styrene-vinyl acetate copolymer resin, ethylene-vinyl acetate copolymer resin, a wax-based resin, and a mixture thereof.

As described above, the magnetic polymer particles serving as magnetic toner are dispersed in the aqueous medium. However, there are cases in which homogeneous and stable dispersion of magnetic polymer particles in a water-based dispersion medium cannot be easily achieved with the ordinary structure of polymer particles because the polymer compound is hydrophobic and the surfaces of the magnetic polymer particles have different characteristics from those of the ordinary polymer particles.

In the exemplary embodiment of the present invention, considering the foregoing standpoint, particularly by using a polymer compound obtained by controlling the type or composition of monomers that form a polymer as described below, excellent dispersibility with respect to the aqueous medium of magnetic polymer particles is obtained, and more excellent development property with respect to the magnetic latent image holding body having water repellency, and the like is exerted. The structure of the polymer compound suitably used in the exemplary embodiment of the present invention will be described hereinafter.

As the polymer compound, desirably, a compound may be used which contains a polymer including ethylenically unsaturated monomers, and the ethylenically unsaturated monomers include a monomer having a hydroxy group, or a hydrophobic monomer, and the amount of the hydroxy group in the polymer is in a range from about 0.1 mmol/g to about 5.0 mmol/g with respect to polymer components exclusive of the magnetic powder.

The liquid developer in the exemplary embodiment of the present invention is produced by dispersing magnetic toner particles (magnetic polymer particles) into the aqueous medium in such a manner described above. Accordingly, in order to obtain excellent dispersibility in the aqueous medium while holding at least a certain value of magnetic force, it is effective that the magnetic toner particles include hydroxy groups on the surfaces of the particles. To this end, constitutional components of the polymer that form the particles preferably have hydroxy groups.

In the polymer of the ethylenically unsaturated monomer that is suitably used as the polymer compound in the exemplary embodiment of the present invention, depending on the copolymerization ratio of a hydrophilic monomer having a hydroxy group and a hydrophobic monomer, considering the viewpoint of dispersibility in the aqueous medium and stability of polymer particles, and the relationship with the amount of magnetic powder contained in the polymer particles by a certain value, the amount of the hydroxy group of the polymer is set in the optimum range.

The amount of the aforementioned hydroxy group varies depending on the amount of the magnetic powder contained, and therefore, it is defined as the amount of hydroxy group with respect to polymer components exclusive of magnetic powder. The amount of hydroxy group with respect to polymer components exclusive of magnetic powder is preferably about 0.1 mmol/g to about 5.0 mmol/g, more preferably about 0.2 mmol/g to about 4.0 mmol/g, and further preferably about 0.3 mmol/g to about 3.0 mmol/g.

If the amount of hydroxy group is less than 0.1 mmol/g, there are cases in which dispersibility of the polymer particles in the aqueous medium may become deteriorated. If the amount of hydroxy group exceeds 5.0 mmol/g, there are cases in which the swelling property of the polymer particles in water may become large and operationability may thereby become deteriorated.

Incidentally, the amount of hydroxy group can be obtained by a general titrimetric method. For example, a certain amount of a reagent such as a pyridine solution of acetic anhydride is added to the aforementioned polymer, and further heated, and water is added thereto, and then subjected to hydrolysis, whereby particles and supernatant fluid are separated from each other by a centrifugal separator. The supernatant fluid thus obtained is titrated with ethanol solution of potassium hydroxide by means of an indicator such as phenolphthalein, whereby the amount of hydroxy group can be obtained.

The aforementioned ethylenically unsaturated monomer refers to a monomer having an ethylenically unsaturated group such as a vinyl group. The ethylenically unsaturated monomer in the exemplary embodiment of the present invention includes a hydrophilic monomer and a hydrophobic monomer, both of which will be mentioned below.

Examples of the hydrophilic monomer having a hydroxy group include 2-hydroxyethyl(meth)acrylate, 2-hydroxypropyl(meth)acrylate, 3-hydroxypropyl(meth)acrylate, glycerin di(meth)acrylate, 1,6-bis(3-acryloxy-2-hydroxypropyl)-hexyl ether, pentaerythritol tri(meth)acrylate, tris-(2-hydroxyethyl) isocyanuric acid ester (meth)acrylate, polyethylene glycol(meth)acrylate, and the like.

Note that the aforementioned (meth)acrylate represents acrylate or methacrylate, and the same applies to the rest.

Among them, at least one of 2-hydroxyethyl(meth)acrylate and polyethylene glycol(meth)acrylate is preferably selected from the standpoints of control of the copolymerization ratio between the hydrophilic monomer and a hydrophobic monomer described below, controllability of polymerization reaction, and the like.

Further, the magnetic polymer particles of the exemplary embodiment of the present invention may have a carboxy group with a hydroxy group in the polymer. In this case, as the ethylenically unsaturated monomer, further, a monomer having a carboxy group may be used.

Examples of the monomer having a carboxy group used in the exemplary embodiment of the present invention include acrylic acid, methacrylic acid, methacryloyloxyethyl monophthalate, methacryloyloxyethyl monohexahydrophthalate, methacryloyloxyethyl monomaleate, and methacryloyloxyethyl monosuccinate, and the like.

Among these monomers, methacryloyloxyethyl monophthalate is preferably used from the standpoints of controlling the copolymerization ratio with respect to the hydrophobic monomer described below, dispersion of magnetic powder in the polymer particles, controllability of a polymerization reaction, and the like.

Examples of the aforementioned ethylenically unsaturated monomer having hydrophobicity include: aromatic vinyl monomers such as styrene and α-methylstyrene; alkyl(meth) acrylate having an alkyl group or aralkyl group that has 1 to 18 (more preferably 2 to 16) carbon atoms (for example, methyl (meth)acrylate, ethyl (meth)acrylate, propyl(meth)acrylate, butyl(meth)acrylate, cyclohexyl(meth)acrylate, 2-ethylhexyl (meth)acrylate, lauryl(meth)acrylate, benzyl(meth)acrylate, or the like); alkoxyalkyl(meth)acrylate having an alkylene group that has 1 to 12 (more preferably 2 to 10) carbon atoms (for example, methoxymethyl(meth)acrylate, methoxyethyl (meth)acrylate, ethoxymethyl(meth)acrylate, ethoxyethyl (meth)acrylate, ethoxybutyl(meth)acrylate, n-butoxymethyl (meth)acrylate, n-butoxyethyl(meth)acrylate or the like); (meth)acrylic acid ester containing an amino group (for example, diethylaminoethyl(meth)acrylate, dipropylaminoethyl(meth)acrylate or the like); acrylonitrile, ethylene, vinyl chloride, vinyl acetate and the like.

Among these compounds, styrene, methyl(meth)acrylate, butyl(meth)acrylate, 2-ethylhexyl(meth)acrylate, lauryl (meth)acrylate, ethoxybutyl(meth)acrylate, benzyl(meth) acrylate, and diethylaminoethyl(meth)acrylate are preferable. Particularly preferable are styrene, methyl(meth) acrylate, and butyl(meth)acrylate.

The content of the hydrophobic monomer that is co-polymerizable with the hydrophilic monomer is preferably from about 1 mass % to about 99 mass % based on the entire monomer components, and more preferably from 5 mass % to 95 mass %. Particularly, in the case in which in addition to the monomer having a hydroxy group, a monomer having a carboxy group such as methacryloyloxyethyl monophthalate is used as the ethylenically unsaturated monomer, the content of the hydrophobic monomer is preferably from 20 mass % to 99 mass % based on the entire monomer components, and more preferably from 50 mass % to 90 mass %.

If the content is less than 1 mass %, the amount of the hydroxy group in the polymer becomes too large, so that homogeneous polymerization may not be achieved in production of the polymer. If the content exceeds 99 mass %, there are cases in which the effect of hydrophilicity as the polymer caused by the hydroxy group could not be obtained.

As the other monomer, a reactive mixture dispersed in the aqueous medium described below (a mixture including the ethylenically unsaturated monomer or the like) may include a cross-linking agent, if necessary, mixed therein. Due to the cross-linking agent being added to the monomer mixture solution, agglomeration during polymerization is restrained and dispersion stability is ensured.

As the cross-linking agent to be used, well known cross-linking agents can be selectively used. Suitable examples thereof include divinylbenzene, ethylene glycol di(meth) acrylate, diethylene glycol di(meth)acrylate, methylenebis (meth)acrylamide, glycidyl(meth)acrylate, 2-([1'-methylpropylidene amino]carboxyamino)ethyl methacrylate and the like. Among these compounds, divinylbenzene, ethylene glycol di(meth)acrylate, and diethylene glycol di(meth)acrylate are more preferable. Further, divinylbenzene is particularly suitable.

Further, the polymer compound in the exemplary embodiment of the present invention may contain a non-crosslinking resin from the viewpoint of improving the fixing property. The non-crosslinking resin is not particularly limited as long as it is a polymer that causes particles to be fixed on a fixing medium such as paper or film due to external energy such as heat, ultraviolet rays or electron beams, or solvent vapor, volatilization of a solvent from a polymer, or the like.

Examples of non-crosslinking resin include homopolymers or copolymers of, for example, styrenes such as styrene and chlorostyrene; monoolefins such as ethylene, propylene, butylene and isoprene; vinyl esters such as vinyl acetate, vinyl propionate and vinyl benzoate; α-methylene aliphatic monocarboxyic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; vinyl ketones such as vinyl methyl ketone, vinyl hexyl ketone and vinyl isopropenyl ketone; and the like.

—Magnetic Powder—

As the magnetic powder, magnetite, ferrite and the like, that are represented by the general formula, $MO \cdot Fe_2O_3$ or $M \cdot Fe_2O_4$, exhibiting magnetization, are preferably be used. Herein, M represents a divalent or monovalent metal ion (Mn, Fe, Ni, Co, Cu, Mg, Zn, Cd, Li or the like), and a single metal or plural metals can be used for M. For example, iron based oxides such as magnetite, γ iron oxide, Mn—Zn based ferrite, Ni—Zn based ferrite, Mn—Mg based ferrite, Li based ferrite and Cu—Zn based ferrite can be exemplified. Among them, inexpensive magnetite can be used more preferably.

Further, as the other metal oxides, non-magnetic metal oxides in which Mg, Al, Si, Ca, Sc, Ti, V, Cr, Mn, Fe, Co, Ni, Cu, Zn, Sr, Y, Zr, Nb, Mo, Cd, Sn, Ba, Pb and the like are used singly or used in combination of two or more, and the aforementioned metal oxides that exhibit magnetization can be used. Examples of the non-magnetic metal oxide include $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$, $ZrO_2$ and the like.

The average primary particle size of the magnetic powder before hydrophobicity-imparting treatment described later is preferably in a range from about 0.02 μm to about 2.0 μm. If the average primary particle size of the magnetic powder is outside the aforementioned range, the magnetic powder is apt to be agglomerated, and homogeneous dispersion thereof into the polymeric monomer may become difficult.

The surface of the magnetic powder is preferably subjected to hydrophobicity-imparting treatment. The method for hydrophobicity-imparting treatment is not particularly limited, and can be carried out by coating the surface of the magnetic powder with a hydrophobic-imparting agent such as various coupling agents, silicone oil, resin or the like. In particular, surface coating processing by means of a coupling agent is desirable.

The surface of the magnetic powder is basically hydrophilic, and therefore, the affinity thereof to the hydrophobic monomer can be enhanced by carrying out hydrophobicity-imparting treatment. With the improvement of compatibility between the hydrophilic monomer and the hydrophobic monomer in the polymer compound, dispersion homogeneity of particles of the magnetic powder can be enhanced.

The amount of the magnetic powder contained is determined by magnetic force to be required. In the exemplary embodiment of the present invention, the content of the magnetic powder is preferably from about 2 mass % to 50 mass % with respect to the total amount of components forming magnetic polymer particles, and more preferably from 4 mass % to about 30 mass %. If the content is within the aforementioned range, sufficient magnetic force is obtained, and dispersion stability with respect to the aqueous medium as polymer particles can be enhanced.

—Other Components—

The magnetic polymer particles of the exemplary embodiment of the present invention further can contain dyes, organic pigments, carbon black, titanium oxide and the like for the purpose of coloring the polymer. In this case, the aforementioned additives can also be added directly to the mixture of the monomer containing magnetic powder dispersed therein, and the like. For example, particularly in the case in which a pigment such as an organic pigment, carbon black, titanium oxide or the like is mixed, the pigment may be in advance mixed with the aforementioned non-crosslinking resin and dispersed by a well known method using a roll mill, a kneader, an extruder or the like and further mixed with a mixture of the polymeric monomer and the like.

In order to produce magnetic polymer particles containing the aforementioned various monomers, for example, the ethylenically unsaturated monomer, a polymerization initiator, and other necessary components are mixed to prepare a mixed liquid of the monomers and the like. The mixing method is not particularly limited.

Further, well known methods can be applied to allow dispersion of the magnetic powder in the mixed liquid. That is to say, a dispersing machine such as a ball mill, a sand mill, an attritor, a roll mill or the like can be used. Incidentally, in the case in which monomer components are in advance polymerized separately and the magnetic powder is dispersed in the polymer thus obtained, a kneading machine such as a roll mill, a kneader, a Banbury mixer, an extruder or the like can be used.

Well known methods can be used to obtain magnetic polymer particles suitably used in the exemplary embodiment of the present invention. For example, a suspension polymerization method, an emulsion polymerization method, a dispersion polymerization method, a seed polymerization method or the like can be suitably used. Further, suspension polymerization can also be performed by using an emulsification method that is known as a membrane emulsification method.

The magnetic polymer particles thus obtained preferably has the number-average particle size of from about 0.1 μm to about 20 μm, and more preferably from about 1.0 μm to about 8.0 μm. If the number-average particle size is less than 0.5 μm, there are cases in which excessively small particle size may cause difficult handling. If the number-average particle size exceeds 5 μm, there are cases in which when the particles are used as image forming material, high image quality could not be obtained.

Further, in the case in which the aforementioned polymer compound has a carboxy group, the amount of the carboxy group is preferably from about 0.005 mmol/g to about 0.5 mmol/g with respect to polymer components exclusive of magnetic powder. If the amount of the carboxy group is within the aforementioned range, even though the number of functional groups is smaller than that of the hydroxy group, excellent dispersibility with respect to the aqueous medium, and the effect of preventing swelling are obtained. Further, these characteristics can be maintained with respect to variations in the case in which other functional groups exist.

The amount of the carboxy group is more preferably from about 0.008 mmol/g to about 0.3 mmol/g, and further preferably from about 0.01 mmol/g to about 0.1 mmol/g with respect to polymer components exclusive of magnetic powder.

The amount of carboxy group can be determined by a general titrimetric method. For example, a reagent such as an ethanol solution of potassium hydroxide is added to the aforementioned polymer compound so as to allow neutralization, and particles and supernatant fluid are separated from each other by a centrifugal machine. The supernatant fluid containing an excess amount of potassium hydroxide is titrated with a solution of isopropanol hydrochloride or the like using an automatic titrator, whereby the amount of carboxy group can be obtained.

The liquid developer in the exemplary embodiment of the present invention is a particle dispersion body in which the aforementioned magnetic polymer particles are dispersed in the aqueous medium such as water.

Examples of the aqueous medium include water, and a solution containing water and a water-soluble organic solvent such as methanol or ethanol. Among them, it is particularly preferable that only water is used. The amount of the water-soluble organic solvent to be added is preferably 30 mass % or less with respect to the entire solvent, more preferably 10 mass % or less depending on the property of the monomer to be suspended.

In production of the liquid developer, various sub-materials that can be used in the ordinary water based particle dispersion body, for example, a dispersing agent, an emulsifier, a surfactant, a stabilizer, a wetting agent, a viscosity-increasing agent, a foaming agent, a defoaming agent, a coagulating agent, a gelling agent, a precipitation inhibiting agent, a charge controller, an antistatic agent, an antioxidant, a softening agent, a plasticizer, a filler, a coloring agent, an aromatic, a surface lubricant, a mold-releasing agent and the like can be used in combination.

Specifically, as the aforementioned surfactant, for example, any known surfactant such as an anionic surfactant, a nonionic surfactant, a cationic surfactant or the like can also be used. Other than these, a silicone based surfactant such as polysiloxane oxyethylene adduct; fluorocarbon surfactant such as perfluoroalkyl carboxyate, perfluoroalkyl sulfonate, oxyethylene perfluoroalkyl ether or the like, and a bio-surfactant such as spiculisporic acid, rhamnolipid, resorcitin and the like; and the like can be described.

Any dispersing agent that is a polymer having a hydrophilic structure section and a hydrophobic structure section can be effectively used. Examples thereof include a styrene-styrenesulfonic acid copolymer, a styrene-maleic acid copolymer, a styrene-methacrylic acid copolymer, a styrene-acrylic acid copolymer, a vinyl naphthalene-maleic acid copolymer, a vinyl naphthalene-methacrylic acid copolymer, a vinyl naphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, a styrene-cyclohexyl methacrylate-methacrylic acid copolymer and the like. These copolymers may have any structure of a random, block, and graft copolymers.

Further, in the exemplary embodiment of the present invention, for the purposes of controlling evaporation property or interfacial property, a water-soluble organic solvent can be used. The water-soluble organic solvent is an organic solvent that is not divided into two phases when added to water. Examples thereof include monovalent or polyvalent alcohols, nitrogen-containing solvent, sulfur-containing solvent, and derivatives thereof.

Moreover, for the purposes of adjustment of conductivity, pH of ink, and the like, added to the aqueous medium are compounds of alkali metal such as potassium hydroxide, sodium hydroxide and lithium hydroxide, nitrogen-containing compounds such as ammonium hydroxide, triethanolamine, diethanolamine, ethanolamine and 2-amino-2-methyl-1-propanol, compounds of alkali earth metal such as calcium hydroxide, acids such as sulfuric acid, hydrochloric acid and nitric acid, strong acids such as ammonium sulfate, weak-alkali salts and the like.

In addition, if necessary, for the purposes of mildew resistance, antisepsis, rust proofing, benzoic acid, dichlorophen, hexachlorophene, sorbic acid and the like may also be used. Further, an antioxidant, a viscosity controller, a conductive agent, an ultraviolet absorber, a chelating agent and the like may also be added.

In the exemplary embodiment of the present invention, the dispersion particle size of the magnetic polymer particles in the liquid developer is preferably 0.1 μm to 20 μm as the average particle size, more preferably 1 μm to 8 μm. The average dispersed particle size of the magnetic polymer particles is a volume-average particle size obtained by the Coulter Counter, Multisizer 3 (manufactured by Beckman Coulter, Inc.).

In the case in which the magnetic polymer particles suitably designed in the exemplary embodiment are used as the magnetic toner in the liquid developer, the magnetic powder is homogeneously dispersed in the particles as described above, and therefore, almost no magnetic powder exists on the surfaces of the particles. Further, the surfaces of the particles each have a hydroxy group, and therefore, excellent dispersibility with respect to the aqueous medium is exhibited.

For this reason, in the case in which the liquid developer as above is used, no microscopic irregularity of surface tension in the liquid occurs, and the mobility of the particles with respect to the magnetic force during development also varies a little between the particles. Therefore, adhesion of the liquid to the magnetic drum after development, based on water repellency of the surface of the magnetic drum described above, or occurrence of image fog is reduced more efficiently.

Production of the liquid developer described above can be performed in the following procedure, but the present invention is not limited thereto.

First, a dispersion medium containing water serving as a main solvent and the aforementioned various additives is prepared by using a magnetic stirrer, and the magnetic polymer particles described above are dispersed in the prepared dispersion medium. The dispersion can be performed by using any known method. That is to say, a dispersing machine such as a ball mill, a sand mill, an attritor, a roll mill or the like can be used. Further, as the dispersion method, there are exemplified a dispersion method in which special stirring blades are rotated at a high speed in a similar manner as a mixer, a method of dispersion by means of shearing force of a rotor/stator known as a homogenizer, a method of dispersing using ultrasonic waves, and the like.

The state in which magnetic polymer particles are independently dispersed in the liquid is confirmed by observation using a microscope of a batched dispersion liquid, and subsequently, the state in which an additive such as an antiseptic agent is added and dissolved is confirmed. Thereafter, the dispersion liquid thus obtained is filtered by using a membrane filter of 100 μm in pore size, so as to remove extraneous substance and coarse particles, whereby the liquid developer serving as a recording liquid for forming an image is obtained.

The viscosity of the liquid developer in the exemplary embodiment of the present invention depends on the image forming system to be used, but it is preferably 1 mPa·s to 500 mPa·s. If the viscosity of the liquid developer is less than 1 mPa·s, the amounts of the magnetic polymer particles and additives are not sufficient, and thus, there are cases where the image density may not be sufficiently obtained. Further, if the viscosity of the liquid developer is greater than 500 mPa·s, the viscosity is too high, thereby resulting in that handling may become difficult or the development property may become deteriorated.

EXAMPLES

Experiments are carried out as below in order to confirm the operation of the exemplary embodiment described above. Unless otherwise specified, the word "part(s)" and the symbol "%" in the examples below express "mass part(s)" and "mass %", respectively.

(Preparation of Magnetic Polymer Particles)

400 parts of styrene acrylic resin (trade name: S-Lec P-SE-0020, manufactured by Sekisui Chemical Co., Ltd.) is added to 600 parts of magnetic powder (trade name: MTS-010 manufactured by Toda Kogyo Corp.), and kneaded by a pressure kneader, whereby magnetic powder (content ratio of the magnetic powder: 60%) whose surface is coated with resin is obtained.

17 parts of hydroxyethyl methacrylate (manufactured by Wako Pure Chemical Industries, Ltd.), 57 parts of styrene monomer (manufactured by Wako Pure Chemical Industries, Ltd.), and 1 part of divinylbenzene (manufactured by Wako Pure Chemical Industries, Ltd.) are mixed together, and subsequently, 40 parts of the aforementioned surface-treated magnetic powder is added thereto, and the resulting mixture is dispersed by using a ball mill for 48 hours. Added to 90 parts of the magnetic powder dispersion liquid is 5 parts of azobisisobutyronitrile (manufactured by Wako Pure Chemical Industries, Ltd.), whereby a mixture containing the monomer and the magnetic powder is prepared.

30 parts of calcium carbonate (trade name: LUMINUS, manufactured by Maruo Calcium Co., Ltd.) serving as a dispersion stabilizer, and 3.5 parts of carboxymethyl cellulose (trade name: CELLOGEN, manufactured by Dai-ichi Kogyo Seiyaku Co., Ltd.) are added to an aqueous solution in which 28 parts of sodium chloride (manufactured by Wako Pure Chemical Industries, Ltd.) is dissolved in 160 parts of ion exchange water, and the resulting product is dispersed by a ball mill for 24 hours to form a dispersion medium.

The mixture obtained as above is put into 200 parts of the dispersion medium and emulsified by an emulsifier (trade name: HIGH-FLEX HOMOGENIZER, manufactured by SMT) for 3 minutes at 8000 rpm, whereby a suspension is obtained. The number-average particle size of the suspension particles is 2.5 μm.

On the other hand, nitrogen is introduced from a nitrogen feed pipe into a separable flask equipped with a stirrer, a temperature meter, a cooling pipe and a nitrogen feed pipe, so that the interior of the flask is brought into a nitrogen environment. Put in the flask is the aforementioned suspension, and is allowed to react at 65° C. for 3 hours, and further, heated at 70° C. for 10 hours, and then cooled. The reaction liquid is made into a favorable dispersion liquid, and an agglomerate cannot be visually confirmed during polymerization.

Added to the reaction liquid is 10% aqueous solution of hydrochloric acid to cause decomposition of calcium carbonate, and thereafter, solid-liquid separation is carried out by centrifugal separation. The obtained particles are washed with 1 L of ion exchange water, and thereafter, are washed in 500 mL of ethanol by carrying out ultrasonic dispersion and centrifugal separation for 30 minutes three times in a repeated manner, whereby magnetic polymer particles are obtained.

The magnetic polymer particles thus obtained are dried in an oven at 60° C., and thereafter, coarse particles are separated by filtering through a mesh of 5 μm in pore size. At this time, the measured number-average particle diameter is 2.7 μm.

Further, the amount of magnetic powder contained in the particles, which amount is calculated from a weight decrement caused by heating based on thermogravimetric analysis (TGA) is 15%.

Further, the amount of hydroxy group in the magnetic powder particles is 0.6 mmol/g. The measurement of the amount of hydroxy group is performed in such a manner as mentioned below.

First, the polymer particles are weighed and put in a test tube with a cap, and a certain amount of a pyridine solution (manufactured by Wako Pure Chemical Co., Ltd.) of previously prepared acetic anhydride (manufactured by Wako Pure Chemical Co., Ltd.) is added thereto, and heated for 24 hours at the temperature condition of 95° C. Further, distilled water is added to the resulting product, and acetic anhydride in the test tube is hydrolyzed, and thereafter, centrifugal separation is performed for 5 minutes at 3000 rpm, and particles and supernatant fluid are separated from each other. The polymer is further washed with ethanol (manufactured by Wako Pure Chemical Co., Ltd.) by performing ultrasonic dispersion and centrifugal separation in a repeated manner, and the supernatant fluid and washing liquid are collected into a conical beaker, and by using phenolphthalein (manufactured by Wako Pure Chemical Co., Ltd.) as an indicator, titration with 0.1 M ethanol solution of potassium hydroxide (manufactured by Wako Pure Chemical Co., Ltd.) is carried out.

A blank test is conducted without using the polymer. Based on the difference between the 1 sample test and the blank test, the amount of hydroxy group (mmol/g) is calculated according to the following expression (1):

$$\text{Amount of hydroxy group}=((B-C)\times 0.1\times f)/(w-(w\times D/100)) \quad (1)$$

In the aforementioned expression (1), B represents the amount of solution dropped in the blank test (mL), C represents the titre in the sample test (mL), f represents a factor of the solution of potassium hydroxide, w represents the weight of particles (g), and D represents the content of magnetic powder in the particles (%).

(Preparation of Liquid Developer)

5 parts of polyvinyl alcohol (PVA; manufactured by Kuraray Co., Ltd., trade name: Kuraray Poval 217, degree of polymerization: 1700, degree of saponification: 88 mol %) is added to 95 parts of cooled ion exchange water, and the resulting mixture is dispersed while being stirred by a magnetic stirrer, and thereafter, heated by a water bath at 70° C. while being stirred and dissolved for 3 hours, whereby a PVA aqueous solution (5% solution) is prepared.

magnetic polymer particles: 5 parts

PVA aqueous solution: 10 parts polyoxyethylene (20) cetyl ether (manufactured by Wako Pure Chemical Co., Ltd.: 0.5 parts ion exchange water: 84.5 parts The aforementioned components are mixed together and dispersed by a ball mill for 3 hours, thereby forming a liquid developer in which the magnetic polymer particles serve as a magnetic toner. 0.1 ml of the liquid developer is sampled, and is dispersed in 100 ml of a measuring liquid isotone (manufactured by Beckman Coulter, Inc.), and the volume-average particle size (dispersed average particle size) measured by using Coulter Counter, Multisizer (manufactured by Beckman Coulter, Inc.) is 3.0 μm.

(Image Formation)

The image forming apparatus 100 having the structure shown in FIG. 1 is used, and the liquid developer obtained above is used as the developer.

The magnetic drum 10 is formed in such a manner that a thin layer of Ni—P serving as a backing layer is plated on an aluminum drum so as to have a film thickness of 15 μm, a thin layer of Co—Ni—P serving as a magnetic recording layer is plated thereon so as to have a film thickness of 0.8 μm, and further, fluorine lubricating plating using fine particles of Ni—P-PTFE is provided on the surface of the magnetic recording layer so as to form a protective layer having a thickness of 1.5 μm. The coercive force of the magnetic recording layer is 400 Oe and the residual magnetic flux density is 7000 G.

The contact angle between the surface of the magnetic drum 10 and pure water is 110 degrees under an environment with a temperature of 25° C. and a humidity of 50% RH.

As the magnetic head 12, a four-channel full-line type magnetic head made from an Mn—Zn ferrite is used which allows formation of pigments of approximately 600 dpi.

As the developing device 14, a developing device is used in which a magnet roll having cylindrical permanent magnets are arranged concentrically in a non-magnetic sleeve made from aluminum is provided as the developing roller 14*a*, and mixing blades are provided in the developer storage container 14*b* so as to stir the liquid developer. The developing device 14 is disposed such that the liquid developer is put in the developer storage container 14*b* and a gap between the non-magnetic sleeve surface and the surface of the magnetic drum 10 becomes 50 μm.

As the intermediate transfer body 16, an intermediate transfer drum made from aluminum and having a silicone rubber layer having a thickness of 7.5 mm on the surface thereof is used, which drum rotates at the same speed as that of the magnetic drum 10. Further, as the transfer/fixing roller 28, an elastic roll is used in which a silicone rubber layer and a fluorine-containing rubber layer are respectively applied to the outer periphery of the core member made from stainless steel in the order indicated. Further, this elastic roll is structured so as to be capable of being heated by a heating element such that the surface temperature thereof becomes 170° C.

The printing conditions are set hereinafter in the image forming apparatus 10 having the structure as above.

the linear velocity of the magnetic drum: 100 mm/second the ratio of the peripheral velocity of the developing roller relative to that of the magnetic drum: 1.2 the transfer condition (intermediate transfer): the force of pressing the intermediate transfer body on the magnetic drum is set at 0.147 MPa (1.5 kgf/cm$^2$).

the transfer/fixing condition: the force of pressing the transfer/fixing roller on the intermediate transfer body is set at 0.245 MPa (2.5 kgf/cm$^2$).

Under the aforementioned conditions, a magnetic latent image (a half-tone image) having a striped pattern of 30 μm/line is formed on the magnetic drum 10 by the magnetic head 12, and the liquid developer is made into contact with the image by the developing roller. Thus, development of the image is performed. For the developed image, the amount of developed toner and reproducibility of a thin line are confirmed by using an ultra-depth laser microscope.

As a result, the toner developed for each line of the latent image has the average height of 4 μm and the average line width of 40 μm. Thus, the magnetic latent image has sufficient development property and a high degree of resolution.

Further, almost no aqueous liquid of the liquid developer adheres to a portion of the developed magnetic drum with no toner image formed thereon.

Moreover, regions of the fixed image in the vicinities of lines are confirmed by using a microscope, but image fog at the level of posing a problem is not at all found on the image.

As a result, in the image forming apparatus of the exemplary embodiment of the present invention in which water repellency of the liquid developer with respect to the magnetic drum is controlled, it is possible to confirm that a high-resolution image is obtained.

The invention also includes the following embodiments.

<1> A magnetic latent image holding body in which the surface thereof has water repellency and a magnetic latent image is visualized by a liquid developer that contains a magnetic toner and an aqueous medium.

<2> The magnetic latent image holding body according to item <1>, wherein the magnetic toner contains magnetic polymer particles that include magnetic powder in a polymer compound.

<3> The magnetic latent image holding body according to item <2>, wherein a dispersed particle size of the magnetic polymer particles has an average particle size of about 0.1 μm to about 20 μm.

<4> The magnetic latent image holding body according to item <2> or item <3>, wherein the content of the magnetic powder is in a range from about 2 mass % to about 50 mass % with respect to the total amount of constitutional components of the magnetic polymer particles.

<5> The magnetic latent image holding body according to any one of items <2> to <4>, wherein the polymer compound includes a polymer of ethylenically unsaturated monomers, and the ethylenically unsaturated monomers include a monomer having a hydroxy group, or a hydrophobic monomer, the amount of the hydroxy group in the polymer being set in a range from about 0.1 mmol/g to about 5.0 mmol/g with respect to polymer components exclusive of the magnetic powder.

<6> The magnetic latent image holding body according to item <5>, wherein the amount of the hydroxy group is set in a range from about 0.3 mmol/g to about 3.0 mmol/g with respect to polymer components exclusive of the magnetic powder.

<7> The magnetic latent image holding body according to item <5>, wherein the monomer having a hydroxy group is at least one selected from the group consisting of 2-hydroxyethyl acrylate, 2-hydroxyethyl methacrylate, polyethylene glycol acrylate and polyethylene glycol methacrylate.

<8> The magnetic latent image holding body according to any one of items <5> to <7>, wherein the ethylenically unsaturated monomers further include a monomer having a carboxy group.

<9> The magnetic latent image holding body according to any one of items <5> to <8>, wherein the amount of the hydrophobic monomer that is co-polymerizable with the monomer having a hydroxy group is in a range from about 1 mass % to about 99 mass % with respect to the entire components of the monomers.

<10> The magnetic latent image holding body according to item <8>, wherein the amount of the hydrophobic monomer that is co-polymerizable with the monomers having a hydroxy group or carboxy group is in a range from about 50 mass % to about 90 mass % with respect to the entire components of the monomers.

<11> The magnetic latent image holding body according to any one of items <5> to <10>, wherein the hydrophobic monomer is at least one selected from the group consisting of styrene, methyl acrylate, methyl methacrylate, butyl acrylate and butyl methacrylate.

<12> The magnetic latent image holding body according to item <8>, wherein the monomer having a carboxy group is methacryloyloxyethyl monophthalate.

<13> The magnetic latent image holding body according to item <8>, wherein the ethylenically unsaturated monomer is a monomer having a carboxy group and wherein the amount of the carboxy group is set in a range from about 0.005 mmol/g to about 0.5 mmol/g with respect to polymer components exclusive of the magnetic powder.

<14> A process cartridge comprising: a magnetic latent image holding body having water repellency on the surface thereof; a developer storage unit in which a liquid developer containing a magnetic toner and an aqueous medium is stored; and a developer supplying unit that supplies the liquid developer to the magnetic latent image holding body having a magnetic latent image formed thereon.

<15> An image forming apparatus comprising: a magnetic latent image holding body having water repellency on the surface thereof; a magnetic latent image forming unit that forms a magnetic latent image on the magnetic latent image holding body; a developer storage unit in which a liquid developer containing a magnetic toner and an aqueous medium is stored; a developer supplying unit that supplies the liquid developer to the magnetic latent image holding body on which a magnetic latent image is formed, so as to visualize the magnetic latent image as a toner image; a transfer unit that transfers the toner image to a recording medium; and a degaussing unit that demagnetizes the magnetic latent image on the magnetic latent image holding body.

<16> The image forming apparatus according to item <15>, wherein a contact angle between the surface of the magnetic latent image holding body and pure water is at least about 70 degrees.

<17> The image forming apparatus according to item <16>, wherein the contact angle is at least about 100 degrees.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A magnetic latent image holding body comprising a magnetic recording layer, the surface of the magnetic latent image holding body having water repellency, and a magnetic latent image formed on the magnetic recording layer being visualized by a liquid developer that contains a magnetic toner and an aqueous medium.

2. The magnetic latent image holding body according to claim 1, wherein the magnetic toner contains magnetic polymer particles that include magnetic powder in a polymer compound.

3. The magnetic latent image holding body according to claim 2, wherein a dispersed particle size of the magnetic polymer particles has an average particle size of about 0.1 μm to about 20 μm.

4. The magnetic latent image holding body according to claim 2, wherein the content of the magnetic powder is in a range from about 2 mass % to about 50 mass % with respect to the total amount of constitutional components of the magnetic polymer particles.

5. The magnetic latent image holding body according to claim 2, wherein the polymer compound includes a polymer of ethylenically unsaturated monomers, and the ethylenically unsaturated monomers include a monomer having a hydroxy group, or a hydrophobic monomer, the amount of the hydroxy group in the polymer being set in a range from about 0.1 mmol/g to about 5.0 mmol/g with respect to polymer components exclusive of the magnetic powder.

6. The magnetic latent image holding body according to claim 5, wherein the amount of the hydroxy group is set in a range from about 0.3 mmol/g to about 3.0 mmol/g with respect to polymer components exclusive of the magnetic powder.

7. The magnetic latent image holding body according to claim 5, wherein the monomer having a hydroxy group is at least one selected from the group consisting of 2-hydroxyethyl acrylate, 2-hydroxyethyl methacrylate, polyethylene glycol acrylate and polyethylene glycol methacrylate.

8. The magnetic latent image holding body according to claim 5, wherein the ethylenically unsaturated monomers further include a monomer having a carboxy group.

9. The magnetic latent image holding body according to claim 5, wherein the amount of the hydrophobic monomer that is co-polymerizable with the monomer having a hydroxy group is in a range from about 1 mass % to about 99 mass % with respect to the entire components of the monomers.

10. The magnetic latent image holding body according to claim 8, wherein the amount of the hydrophobic monomer that is co-polymerizable with the monomers having a hydroxy group or carboxy group is in a range from about 50 mass % to about 90 mass % with respect to the entire components of the monomers.

11. The magnetic latent image holding body according to claim 5, wherein the hydrophobic monomer is at least one selected from the group consisting of styrene, methyl acrylate, methyl methacrylate, butyl acrylate and butyl methacrylate.

12. The magnetic latent image holding body according to claim 8, wherein the monomer having a carboxy group is methacryloyloxyethyl monophthalate.

13. The magnetic latent image holding body according to claim 8, wherein the ethylenically unsaturated monomer is a monomer having a carboxy group and wherein the amount of the carboxy group is set in a range from about 0.005 mmol/g to about 0.5 mmol/g with respect to polymer components exclusive of the magnetic powder.

14. A process cartridge comprising:

a magnetic latent image holding body comprising a magnetic recording layer, the surface of the magnetic latent image holding body having water repellency;

a developer storage unit in which a liquid developer containing a magnetic toner and an aqueous medium is stored; and a developer supplying unit that supplies the liquid developer to the magnetic recording layer having a magnetic latent image formed thereon.

15. An image forming apparatus comprising:

a magnetic latent image holding body comprising a magnetic recording layer, the surface of the magnetic latent image holding body having water repellency;

a magnetic latent image forming unit that forms a magnetic latent image on the magnetic recording layer;

a developer storage unit in which a liquid developer containing a magnetic toner and an aqueous medium is stored;

a developer supplying unit that supplies the liquid developer to the magnetic recording layer on which a magnetic latent image is formed, so as to visualize the magnetic latent image as a toner image;

a transfer unit that transfers the toner image to a recording medium; and a degaussing unit that demagnetizes the magnetic latent image on the magnetic latent image holding body.

16. The image forming apparatus according to claim 15, wherein a contact angle between the surface of the magnetic latent image holding body and pure water is at least about 70 degrees.

17. The image forming apparatus according to claim 16, wherein the contact angle is at least about 100 degrees.

* * * * *